US008926400B2

(12) United States Patent
Jones et al.

(10) Patent No.: US 8,926,400 B2
(45) Date of Patent: Jan. 6, 2015

(54) UNIFORMITY DURING PLANARIZATION OF A DISK

(75) Inventors: Neale M. Jones, Morgan Hill, CA (US); Kurt A. Rubin, San Jose, CA (US)

(73) Assignee: HGST Netherlands B.V., Amsterdam (NL)

( * ) Notice: Subject to any disclaimer, the term of this patent is extended or adjusted under 35 U.S.C. 154(b) by 237 days.

(21) Appl. No.: 13/414,568

(22) Filed: Mar. 7, 2012

(65) Prior Publication Data

US 2013/0236678 A1 Sep. 12, 2013

(51) Int. Cl.
*B24B 1/00* (2006.01)
*B24B 5/02* (2006.01)
*B24B 5/313* (2006.01)

(52) U.S. Cl.
USPC ..... 451/41; 451/59; 451/63; 451/267; 451/269; 451/290

(58) Field of Classification Search
CPC ..... B24B 37/32; B24B 37/28; B24B 37/08; B24B 7/17
USPC ..... 451/36, 37, 41, 57, 59, 63, 262, 267, 451/268, 269, 288, 290, 397, 398
See application file for complete search history.

(56) References Cited

U.S. PATENT DOCUMENTS

| | | | | |
|---|---|---|---|---|
| 5,749,771 | A | 5/1998 | Isobe | |
| 5,876,273 | A | 3/1999 | Yano et al. | |
| 5,914,053 | A * | 6/1999 | Masumura et al. | 216/88 |
| 5,967,882 | A * | 10/1999 | Duescher | 451/57 |
| 6,251,000 | B1 | 6/2001 | Murakami et al. | |
| 6,394,886 | B1 | 5/2002 | Chen et al. | |
| 6,558,232 | B1 | 5/2003 | Kajiwara et al. | |
| 6,612,905 | B2 | 9/2003 | Nguyen | |
| 7,004,827 | B1 | 2/2006 | Suzuki et al. | |
| 2006/0099893 | A1 * | 5/2006 | Masunaga et al. | 451/287 |
| 2013/0316627 | A1 * | 11/2013 | Volovich et al. | 451/385 |

FOREIGN PATENT DOCUMENTS

| | | | |
|---|---|---|---|
| JP | 5123963 | A | 5/1993 |
| JP | 7112360 | A | 5/1995 |
| JP | 1110527 | A | 1/1999 |
| JP | 11170165 | A | 6/1999 |
| JP | 11254305 | A | 9/1999 |
| JP | 2005199388 | A | 7/2005 |
| WO | 2009110180 | A1 | 9/2009 |

OTHER PUBLICATIONS

I. Sneddon, "The Relation Between Load and Penetration in the Axisymmetric Boussinesq Problem for a Punch of Arbitrary Profile" International Journal of Engineering Science, May 1965, vol. 3 Issue 1, Abstract, Scotland.

* cited by examiner

*Primary Examiner* — Timothy V Eley
(74) *Attorney, Agent, or Firm* — Kunzler Law Group, PC

(57) ABSTRACT

An apparatus, system, and method are provided for reducing edge damage of a disk during chemical mechanical polishing. The apparatus includes a disk carrier configured to receive a disk, the disk having an outside edge and an inside edge, a raised ring adjacent the outside edge of the disk and extending from a surface of the disk carrier to a height greater than a height of the disk, and a raised column adjacent the inside edge of the disk and having a height greater than a height of the disk. The system includes a disk carrier for receiving a disk, a raised ring adjacent the outside edge of each opening, and plugs insertable into a central opening in the disk and having a height greater than a height of the disk. The method includes providing the apparatus, inserting a disk into the apparatus, and polishing the disk.

16 Claims, 10 Drawing Sheets

900

UNIFORMITY DURING PLANARIZATION OF A DISK

TECHNICAL FIELD

The subject matter disclosed herein relates to computer readable storage disks and more particularly relates to fabricating computer readable storage disks.

BACKGROUND

Hard-disk drives have rotating high-precision disks that are coated on both sides with a special thin film medium designed to store information in the form of magnetic patterns. Electromagnetic read/write heads suspended or floating only fractions of micro inches above the disk are used to either record information onto the thin film medium, or read information from the medium.

A read/write head may write information to the disk by creating an electromagnetic field to orient a cluster of magnetic grains in one direction or the other. Each grain will be a magnetic dipole pointing in a certain direction and also creating a magnetic field around the grain. All of the grains in a magnetic region typically point in the same direction so that the magnetic region as a whole has an associated magnetic field. The read/write head writes regions of positive and negative magnetic polarity, and the timing of the boundaries between regions of opposite polarity (referred to as "magnetic transitions") is used to encode the data. To increase the capacity of disk drives, manufacturers are continually striving to reduce the size of the grains.

The ability of individual magnetic grains to be magnetized in one direction or the other, however, poses problems where grains are extremely small. The superparamagnetic effect results when the product of a grain's volume (V) and its anisotropy energy ($K_u$) fall below a certain value such that the magnetization of that grain may flip spontaneously due to thermal excitations. Where this occurs, data stored on the disk is corrupted. Thus, while it is desirable to make smaller grains to support higher density recording with less noise, grain miniaturization is inherently limited by the superparamagnetic effect.

In response to this problem, engineers have developed patterned media, where the magnetic thin film layer is created as an ordered array of highly uniform pillars, each pillar capable of storing an individual bit. Each bit may be one grain, or several exchange-coupled grains, rather than a collection of random decoupled grains. In this manner, patterned media effectively reduces noise by imposing sharp magnetic transitions at well-defined pre-patterned positions, known as bit patterns. Bit patterns are organized as concentric data tracks around a disk.

One benefit of patterned media is the ability to overcome the above described superparamagnetic effect. Due to their physical separation and reduced magnetic coupling to one another, the magnetic pillars function as individual magnetic units, comprised either of single grains or a collection of strongly-coupled grains within each pillar. Since these magnetic pillars are typically larger than the individual grains in conventional media, their magnetization is thermally stable.

Conceptually, patterned media is a simple notion; however, mass producing disks at a reasonable cost is an immense challenge. Fabrication of a patterned media disk requires, in one example, etching a pattern of pillars or islands in the surface of a disk, depositing a non-magnetic material on the etched surface of the disk (which subsequently covers the islands), and "planarizing" the surface of the disk until the magnetic islands are again uniformly exposed. However, chemical-mechanical planarization of patterned disks currently requires significant over-polish to achieve uniformity. The over-polish can damage the inside and outside diameter of the disk.

BRIEF SUMMARY

The subject matter of the present application has been developed in response to the present state of the art, and in particular, in response to the problems and needs in the art that have not yet been fully solved by currently available patterned magnetic storage mediums and/or methods of forming patterned magnetic storage mediums.

An apparatus, system, and method are provided for reducing edge damage of a disk during chemical-mechanical polishing. The apparatus, in one embodiment, includes a disk carrier configured to receive a disk. The disk includes an outside edge and an inside edge. The disk carrier has a raised ring that is adjacent the outside edge of the disk and extends from a surface of the disk carrier to a height greater than a height of the disk. The disk carrier also has a raised area that is adjacent the inside edge of the disk and has a height greater than a height of the disk.

The apparatus may also include a step area disposed between the raised ring and the disk. The step area has a height less than or equal to the height of the disk. A difference in height of the raised ring and the disk is in the range of between about 0 and 4 mm.

The raised area may be a plug insertable into a central opening of the disk. A difference in height between the raised area and the disk is in the range of between about 0 and 4 mm. In one embodiment, the carrier is configured with an opening configured to receive the disk and enable simultaneous chemical-mechanical planarization (e.g., polishing) of both sides of the disk. In one embodiment, the raised area may be physically connected to the bulk of the disk carrier at the OD or may be a removable ring.

The system includes a disk carrier having openings to receive a disk. Further, the disk carrier includes a raised ring adjacent the outside edge of each of the openings that extends from a surface of the disk carrier to a height greater than a height of the disk. The disk carrier also includes plugs that are insertable into a central opening in the disk and have a height greater than a height of the disk.

The method includes providing a disk carrier configured to receive a disk. The disk has an outside edge and an inside edge. The disk carrier has a raised ring adjacent the outside edge of the disk that extends from a surface of the disk carrier to a height greater than a height of the disk. The disk carrier also includes a raised area adjacent the inside edge of the disk that has a height greater than a height of the disk. The method includes inserting a disk into the disk carrier and polishing the disk using chemical-mechanical polishing.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
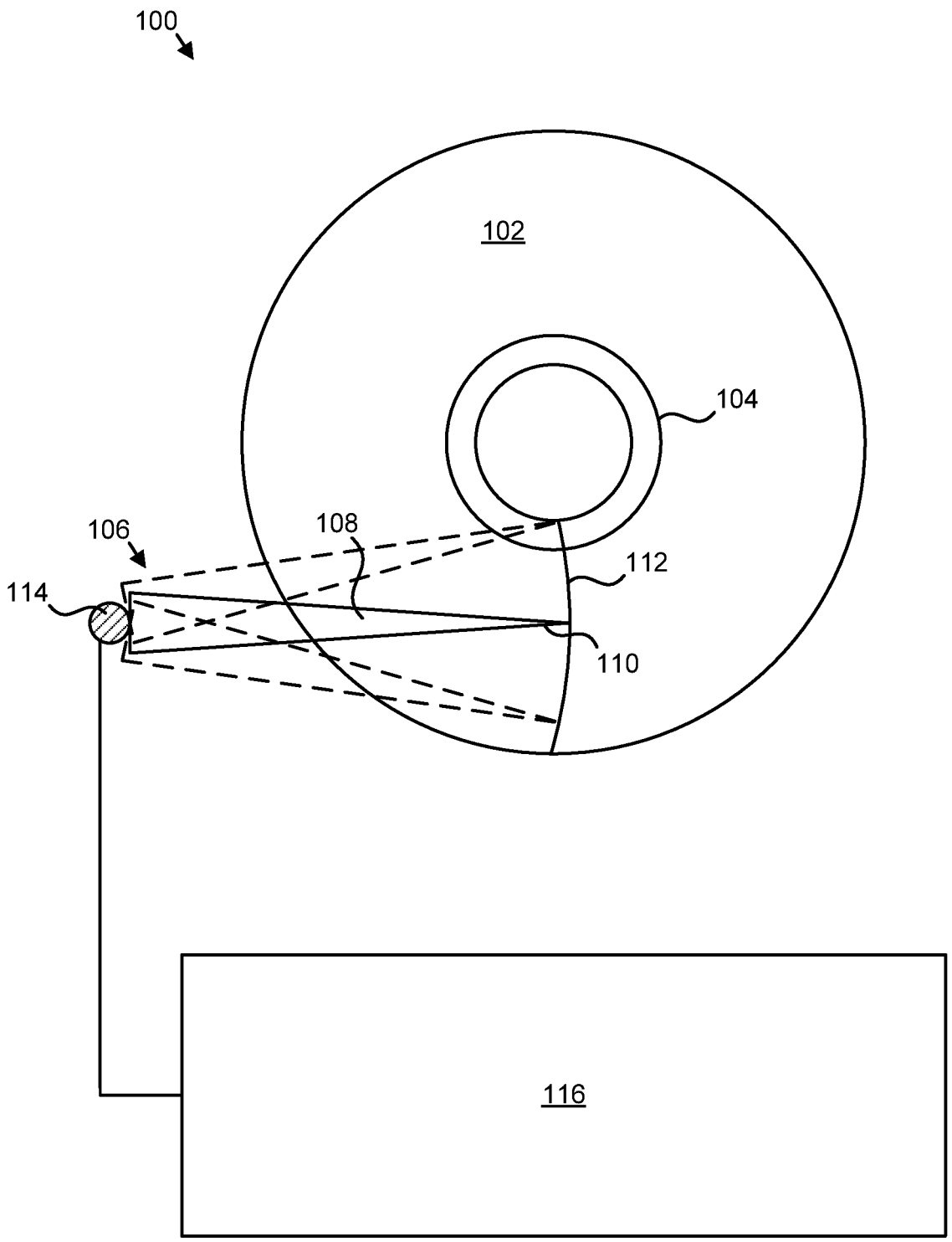
FIG. 1 is a schematic block diagram illustrating a hard-disk drive assembly.

FIG. 1 is a schematic block diagram illustrating a hard-disk drive assembly 100. The hard-disk drive assembly 100 includes at least one hard disk 102 with opposing disk surfaces. The assembly 100 includes a spindle motor (not shown) that is controllable to rotate the hard disk 102 at high speeds during operation. Concentric data tracks 104 formed on either or both disk surfaces receive and store magnetic information.

A read/write head 110 may be moved across the disk surface by an actuator assembly 106, which allows the head 110 to read or write magnetic data to a particular track 104. The actuator assembly 106 may pivot on a pivot 114. The actuator assembly 106 may form part of a closed loop feedback system, known as servo control, which dynamically positions the read/write head 110 to compensate for thermal expansion of the disks 102 as well as vibrations and other disturbances. Also involved in the servo control system is a complex computational algorithm executed by a control module 116. The control module 116 may include a microprocessor, digital signal processor, or analog signal processor that receives data address information from an associated computer, converts the information to a location on a disk 102, and moves the read/write head 110 accordingly.

Figure 2:
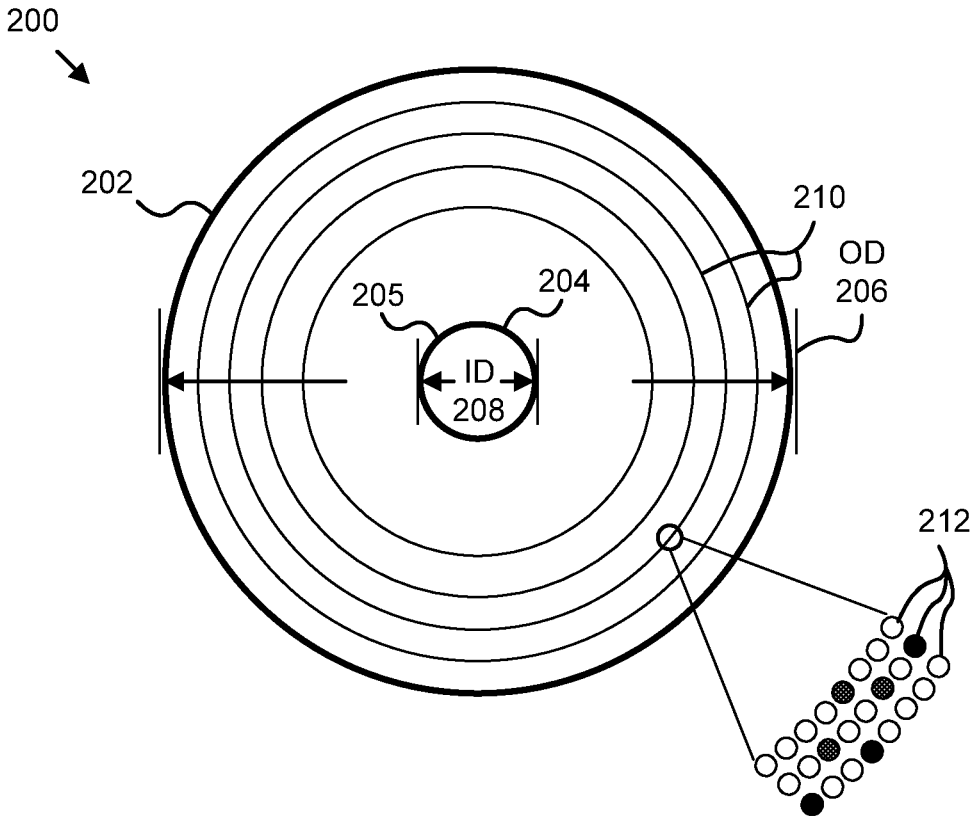
FIG. 2 is a schematic block diagram illustrating a plan view of a disk containing patterned magnetic media.

FIG. 2 is a schematic block diagram illustrating a plan view of a disk 200 containing patterned magnetic media. The disk 200 includes a circular outside edge 202 defining an outside diameter (OD) 206 of the disk, a central opening 204, an inside edge 205 defining an inside diameter (ID) 208 of the disk, tracks 210, and data recording bits 212.

Each track 210, which is a ring on the disk 200 where data can be written, is used to identify where information is stored. A track 210 of patterned magnetic media generally includes a number of highly uniform pillars 212. Each pillar is capable of storing an individual data recording bit that corresponds to a binary digit.

Electromagnetic read/write heads suspended or floating only fractions of micro inches above the disk 200 are used to either record information onto a magnetic layer or read information from it. In certain embodiments, the read/write head flies just a few nanometers above the surface of the disk 200. Consequently, precision, substrate integrity, and disk smoothness are essential to achieve quality data throughput.

A read/write head may write information to the disk 200 by creating an electromagnetic field to orient a bit on a pillar 212, in one direction or the other. To read information, magnetic patterns detected by the read/write head are converted into a series of pulses which are sent to the control module 116 to be converted to binary data and processed by an attached computing system (not shown).

Patterned media with isolated pillars 212 enables the bit size to be reduced without causing instability known as the superparamagnetic effect. In conventional multigrain magnetic media, for example, bits are generally created by covering a flat substrate with a thin layer of magnetic alloy, which comprises formed clusters of atoms on the substrate surface known as grains. Each grain operates as a partially independent unit of magnetization subject to influence from other grains. Data stored in tracks 210 is comprised of regions of alternating magnetic polarity.

Manufacturers of conventional hard disk drives employ many tactics to increase storage density. For example, tracks may be made narrower, or the length of the regions of alternating polarity along the track may be reduced. Shrinking these dimensions generally requires that the size of the random grains in the media be reduced, so that sharp boundaries and sharp track edge boundaries can be defined by the magnetic write head. If grains are too large, the signal to noise ratio of the recording system suffers, and data errors are generated at an unacceptable rate. On the other hand, if the grains are too small, they may become unstable from thermally induced vibrations and spontaneously reverse their magnetic polarity (leading to loss of stored data). As a result of the superparamagnetic effect, the areal density of stable conventional hard disk drives has typically been restricted to around 150 Gbit/in$^2$ for conventional multigrain magnetic recording media.

One benefit of patterned media is the ability to overcome the above described superparamagnetic effect. Forming pillars 212 on the substrate of the disk 200 increases the storage capacity and reduces the risk of losing data due to magnetic grain instability.

Due to their physical separation and reduced magnetic coupling to one another, the magnetic pillars 212 function as individual magnetic units, comprised either of single grains or a collection of strongly-coupled grains within each pillar. Since these magnetic pillars 212 are typically larger than the individual grains in conventional media, their magnetization is thermally stable.

In one embodiment, the magnetic pillars 212 are formed by etching patterns into the surface of the disk 200. The pattern may resemble pillars 212 or islands having grooved regions between the pillars 212 or islands. The grooved regions are then filled first with a stop layer then with a non-magnetic filler material. The surface of the disk 200 is then polished using chemical-mechanical planarization techniques to achieve a substantially uniform surface. In some implementations, a thickness of the stop layer proximate the radially outer periphery and/or radially inner periphery is greater than a thickness of the stop layer proximate a middle diameter of the disk between the radially outer and inner peripheries. The thickness of the stop layer proximate at least one of the radially outer periphery and radially inner periphery can be at least 10% greater than the thickness of the stop layer proximate the middle diameter of the disk.

Figure 3:
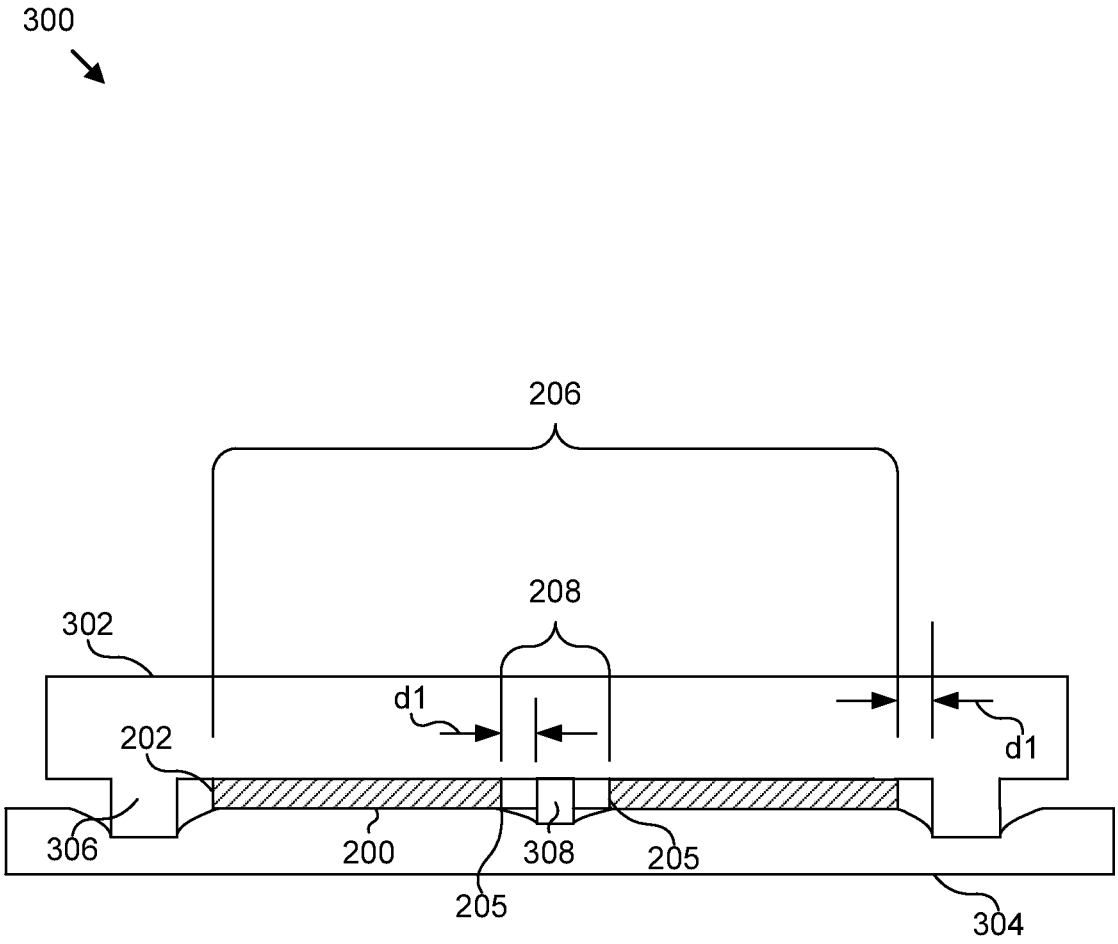
FIG. 3 is a schematic block diagram illustrating a cross-sectional view of one embodiment of an apparatus for reducing edge damage of the disk during planarization.

FIG. 3 is a schematic block diagram illustrating a cross-sectional view of one embodiment of an apparatus 300 for reducing edge damage of the disk 200 during planarization. Edge damage during planarization is the result of what is known as Boussinesq's problem. When a rigid cylinder, such as a disk 200, is pressed against an elastic "half-space," such as the polishing pad 304, the pressure on the cylinder increases greatly at the outside diameter of the cylinder. The apparatus 300 reduces the pressure at the outside and inside diameter of the disk 200 so that the pressure across the disk is substantially uniform. As such, during planarization, the outside and inside edges are polished at substantially the same rate as the rest of the disk 200.

The apparatus 300 includes a carrier 302 for supporting, guiding, and applying pressure to the disk 200 during the polishing process. A polishing compound, such as a slurry, is applied together with a flexible polishing pad 304 and moved across the surface of the disk 200 to polish or planarize the disk 200.

As used herein, the term "edge" refers to the outside edge 202 and the inside edge 205 of the disk 200. The profile of the carrier 302 reduces over-polishing that may occur at the outside and inside edges 202, 205 of the disk 200 by compressing the polishing pad 304 near the outside and inside edges 202, 205. Compressing the polishing pad near the outside and inside edges 202, 205 overcomes the problem of excessive pressure from the polishing pad 304 that leads to edge damage.

As depicted, the profile of the carrier 302 includes portions or protrusions 306, 308 extending downward from the carrier 302. These portions 306, 308 may be integrally formed with the carrier 302, or alternatively, attached to the carrier 302. The outer portion 306 forms a ring around the outside edge 202 of the disk 200, and the inner portion 308 forms a hub or plug that is insertable into the central opening 204 of the disk 200. In one embodiment, the carrier 302 is formed having a radial distance d1 in the range of between about 0.05 and 5 mm. The radial distance d1 is selected to allow the disk 200 to be inserted into the carrier 200 while still securely maintaining the disk 200 during polishing.

The portions 306, 308, in one embodiment, are formed having a substantially square or rectangular cross-sectional profile. Alternatively, the cross-sectional profile of the portions 306, 308 may be formed of any geometric shape that compresses the polishing pad 304.

Figure 4:
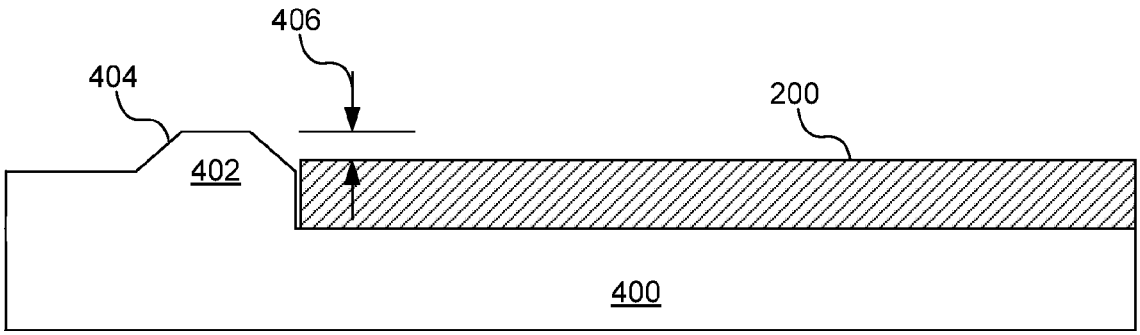
FIG. 4 is a side cross-sectional diagram of another embodiment of an apparatus 400 for reducing edge damage of a disk.

FIG. 4 is a side cross-sectional diagram of another embodiment of a carrier 400 for reducing edge damage of a disk 200. The partial view of FIG. 4 illustrates an alternative profile shape of the outer ring 402. As described above, the outer ring 402 may be formed having any cross-sectional geometric shape that compresses the polishing pad 304. In the depicted embodiment, the outer ring 402 is formed with chamfered edges 404. The chamfered edges 404 increase the useful life of a polishing pad by reducing sharp edges that contact the polishing pad. The chamfered edge may have a curved or straight cross-sectional profile. The outer ring 402, in one embodiment, has a height 406 in the range of between about 0 mm and about 0.1 mm. The height 406 is defined as the vertical distance from a top surface of the outer ring 402 to a top surface of disk 200. The height 406 is selected to maximize uniformity of the disk surface 200 through CMP.

Minor changes in the height 406 make a difference in uniformity. In one embodiment, the height 406 for maximized uniformity depends on the type of disk 200, type of polishing pad, and type of polishing compound utilized. The maximized height 406, therefore, may be determined by experimentation. The height 406 in relation to the carrier body is in the range of between about 0.01 mm and about 0.1 mm. Alternatively, the height 406 in relation to the disk 200 is in the range of between about 0.005 and about 0.635 mm. It should be noted that the height 406 described here with reference to FIG. 4 is equally applicable to the discussion of the carrier described above with reference to FIG. 3.

In certain embodiments, the height 406 is defined as a ratio of the height of the outer ring 402 to the height of the disk 200 as measured from the surface of the substrate, or carrier 400. The ratio, in one example is in the range of between about 1.01:1 and 1.12:1. In an alternative embodiment, the ratio is between 1.006:1 and 1.8:1. In one embodiment, the height 406 of the inner portion 308 of FIG. 3 is substantially equivalent to the height of the outer ring 402. Alternatively, the height of the inner portion 308 is independent of the height of the outer ring 402 and is defined as a ratio of the height of the inner portion 308 to the disk 200. The ratio of the height of the inner portion 308 to the disk 200 is in the range of between about 1.01:1 and 1.12:1. In an alternative embodiment, the ratio of the inner portion 308 to the disk 200 is in the range of between about 1.006:1 and 1.8:1.

Figure 5:
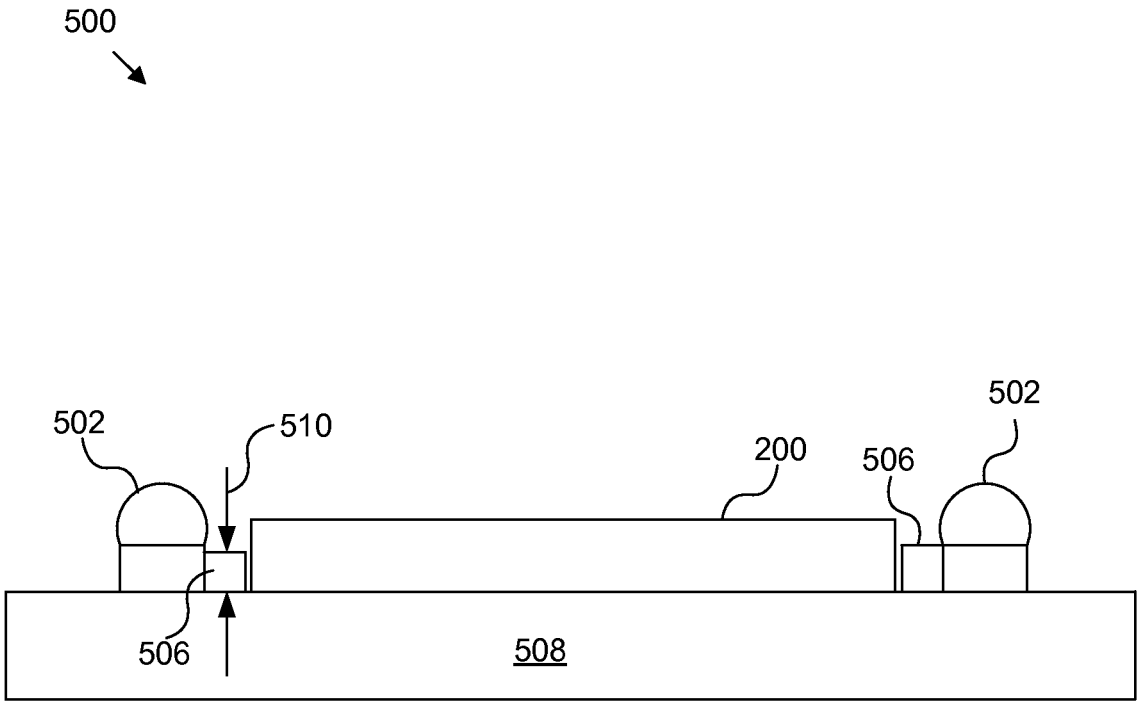
FIG. 5 is another side cross-sectional diagram of an embodiment of an apparatus 500 for reducing edge damage of a disk.

FIG. 5 is another side cross-sectional diagram of an embodiment of an apparatus 500 for reducing edge damage of a disk 200. The apparatus 500, as described above, may include a protrusion 502, but with different cross-sectional profiles. In the depicted embodiment, the protrusion 502 has a substantially circular profile. As described above, smoothed cross-sectional profiles increase the useful life of the polishing pad by reducing sharp edges that may wear down the polishing pad as the polishing pad moves across the raised area of the protrusion 502.

The protrusion 502, additionally, may be formed having a step 506 disposed between the protrusion 502, and the disk 200. The step 506, like the protrusion 502, forms a circular raised area around the disk 200 for securing the disk 200 and limiting horizontal movement with reference to the carrier 508. Accordingly, the step 506 includes an ID that is approximately equal to (e.g., just larger than) the OD of the disk. The step 506, in one embodiment, forms a buffer area between the disk 200 and protrusion 502 to allow the polishing pad to at least partially uncompress.

The step 506, in one example, has a height less than or equal to the height of the disk 200. Accordingly, in some implementations, the height 510 of the step 506 is in the range of between about 0 mm and about 0.1 mm. Alternatively, the height 510 is in the range of between about 0.025 mm and about 0.75 mm. The height 510 is less than or equal to the height of the disk 200 so as to allow the polishing pad to fully contact the outside or inside edges 202, 205 of the disk 200. Stated differently, if the height 510 of the step 506 area exceeded the height of the disk, then the polishing pad might not fully engage the outside or inside edges 202, 205 of the disk and thereby lead to a non-uniform polishing.

Figure 6:
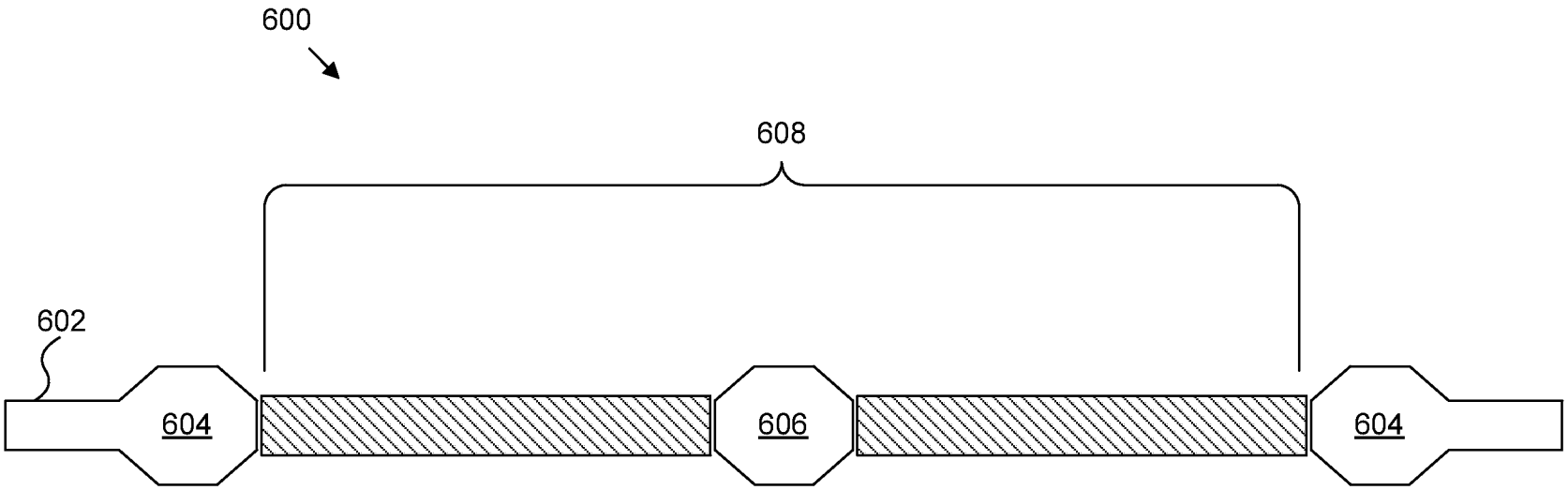
FIG. 6 is a schematic block diagram illustrating a cross-sectional view of a system 600 for polishing both sides of a disk.

FIG. 6 is a schematic block diagram illustrating a cross-sectional view of a system 600 for polishing both sides of a disk 200. The system 600 includes a carrier 602 that includes protrusions 604, 606 on both sides of the carrier 602. As such, the carrier 602 is capable of enabling simultaneous polishing of both sides of the disk 200. The carrier 602, shown partially here, has openings 608 for receiving the disk 200. The opening 608 is circular, like the disk 200, and has a diameter slightly greater than the outside diameter of the disk 200. The diameter of the opening 608 is selected to allow the disk 200 to be inserted in the carrier 602 while still frictionally securing the disk 200 in the carrier 602.

The protrusion 606 is formed as a plug or hub that is insertable into the central opening of the disk 200. The diameter of the protrusion 606 is slightly less than the diameter of the central opening. The protrusion 606, in one embodiment, is maintained in the central opening by friction. The difference in diameter between the protrusion 606 and the central opening is in the range of between about 1 and 5 mm.

Figure 7:
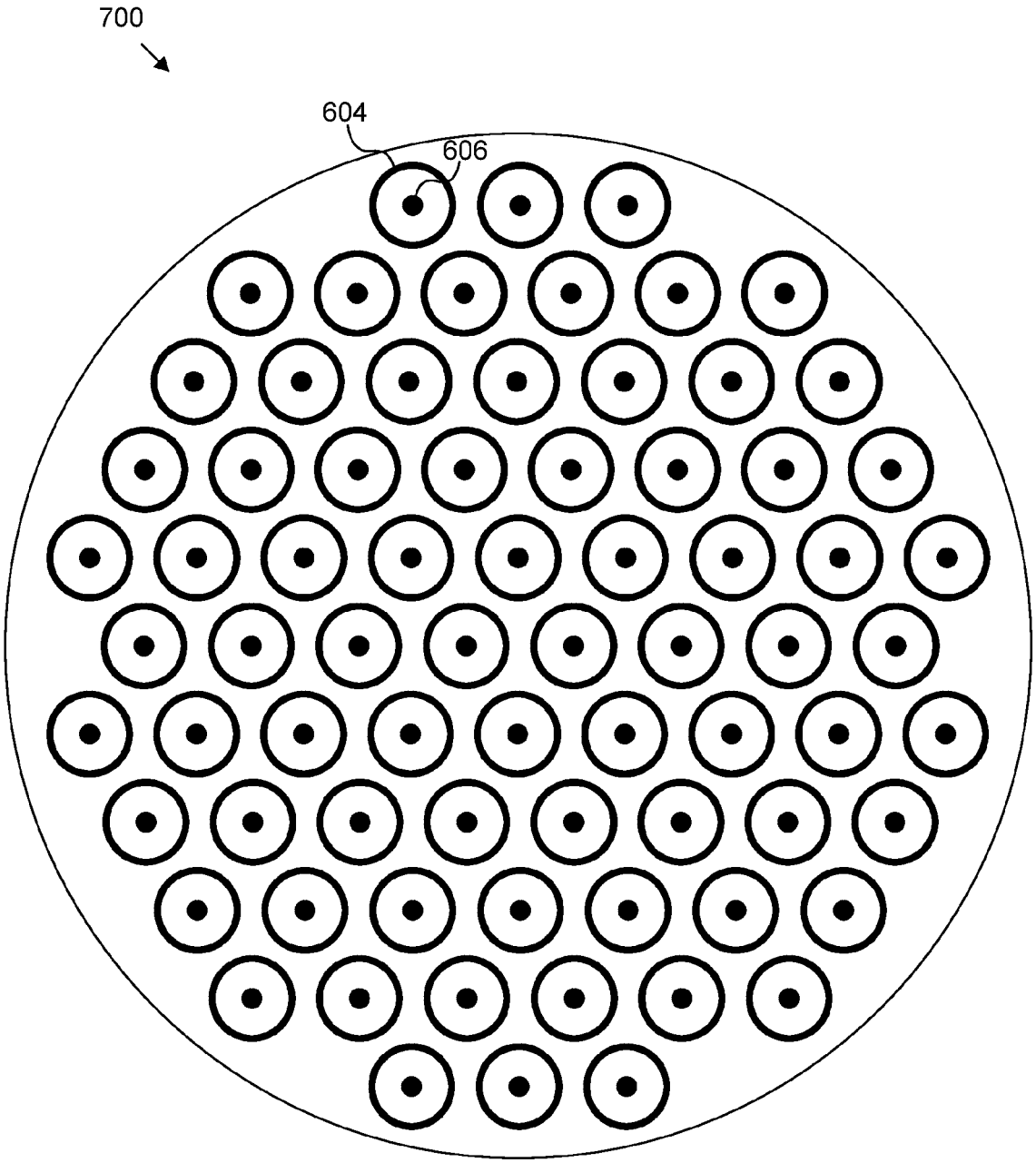
FIG. 7 is a plan view diagram illustrating one embodiment of a carrier having multiple openings for receiving disks.

FIG. 7 is a plan view diagram illustrating one embodiment of a carrier 700 having multiple openings 608 for receiving disks. The openings 608, as described above with reference to FIG. 6, are configured to receive disks 608 and include the raised portions 604, 606. The carrier 700 may be formed of a rigid polymer, metal, glass, or composite material. The material is selected having a rigidity sufficient to maintain the shape of the carrier 700 during CMP. One example of a material capable of use as the carrier is polyether ether ketone (PEEK). Other examples of materials suitable for a carrier include polycarbonate, polyethyleneterephalate, polyethersulfone, polyphenelynesulfide, and proprietary materials. Another example of a material capable of use as a carrier contains fiberglass. The rings and carriers may be made from different materials.

The carrier 700 is configured for simultaneous polishing of both sides of multiple disks. Polishing pads (not shown here) are pressed on both sides of the carrier, after disks are inserted, and the polishing pads together with the polishing compound uniformly planarize the disks. The raised areas 604, 606 reduce over polishing and edge damage of the disks.

Figure 8:
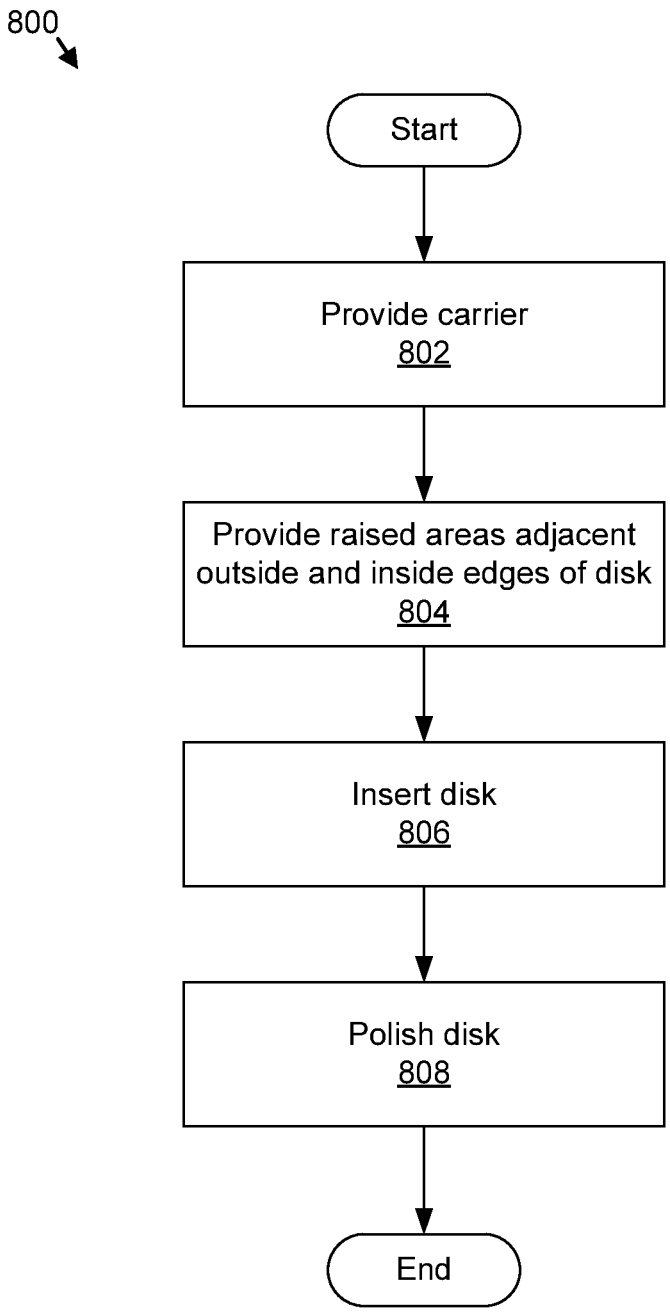
FIG. 8 is a schematic flow chart diagram illustrating one embodiment of a method for planarizing a disk.

FIG. 8 is a schematic flow chart diagram illustrating one embodiment of a method 800 for planarizing a disk. The method 800 starts and a carrier is provided 802. Providing 802 the carrier comprises, in one embodiment, providing a carrier as described above with reference to FIGS. 3-7. The carrier is provided 804 with raised areas adjacent the outside and inside edges of the disk. The raised areas include a cross-sectional pressure profile that is in the form of a geometric shape. The pressure profile is configured to compress the polishing pad to reduce over polishing of the disk at the outside and inside edges of the disk. The pressure profile may, in one embodiment, include sloped or chamfered edges to reduce wear on the pressure pad. Furthermore, other geometric shapes may be utilized, including substantially circular profiles, for reducing wear on the pressure pad from sharp edges.

In a further embodiment, the raised areas are provided with a step area disposed between the raised are and the disk. The raised area is provided 804 with a height greater than the disk. The step area is provided with a height less than or equal to the disk. The method 800 continues and the disk is inserted 806 into the carrier, and then polished 808 as is known to those of skill in the art of chemical mechanical polishing.

The resulting disk is formed having an outer surface defining a radially outer periphery of the annular disk, and an inner surface defining a radially inner periphery of the annular disk. The disk has opposing substantially planar surfaces extending between the outer and inner surfaces, with a distance between the planar surfaces defining a thickness of the annular disk. The thickness of the annular disk at the outer surface is about 95% of a maximum thickness of the annular disk, and the thickness of the annular disk at the inner surface is at least about 95% of the maximum thickness of the annular disk.

Figure 9:
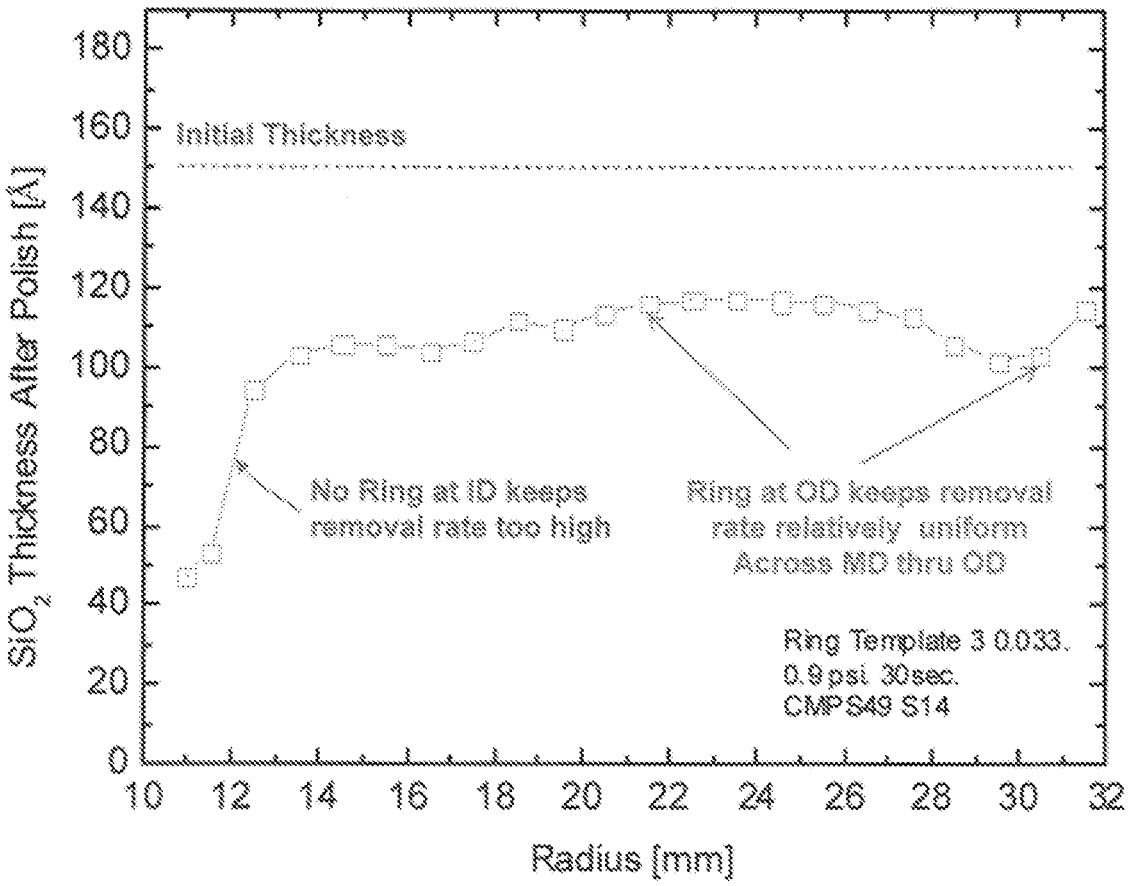
FIG. 9 is a graph illustrating the effects of over-polishing a disk with and without a raised area or ring.

FIG. 9 is a graph 900 illustrating the effects of over polishing a disk with and without a raised area or ring. The graph 900 shows one specific example of a $SiO_2$ disk with an initial thickness of 150 Å (Angstrom) polished at 0.9 psi for 30 seconds. In this example, an inner raised area is not used to illustrate the effectiveness of the raised areas in reducing edge damage (i.e., excessive thinning from over polishing at the edges). Without the inner raised area, the thickness of the disk at the inside edge drastically drops from about 100 Å to about 50 Å at 12 mm.

The graph 900 illustrates that the outer raised area significantly improves uniformity of the removal rate as a function of radius. The thickness of the outer edge remains substantially uniform in the range of between 100 and 120 Å. This is a result of the reduced pressure at the outside edge.

The schematic flow chart diagram is generally set forth as logical flow chart diagrams. As such, the depicted order and labeled steps are indicative of representative embodiments. Other steps and methods may be conceived that are equivalent in function, logic, or effect to one or more steps, or portions thereof, of the methods illustrated in the schematic diagrams. Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown.

Figure 10:
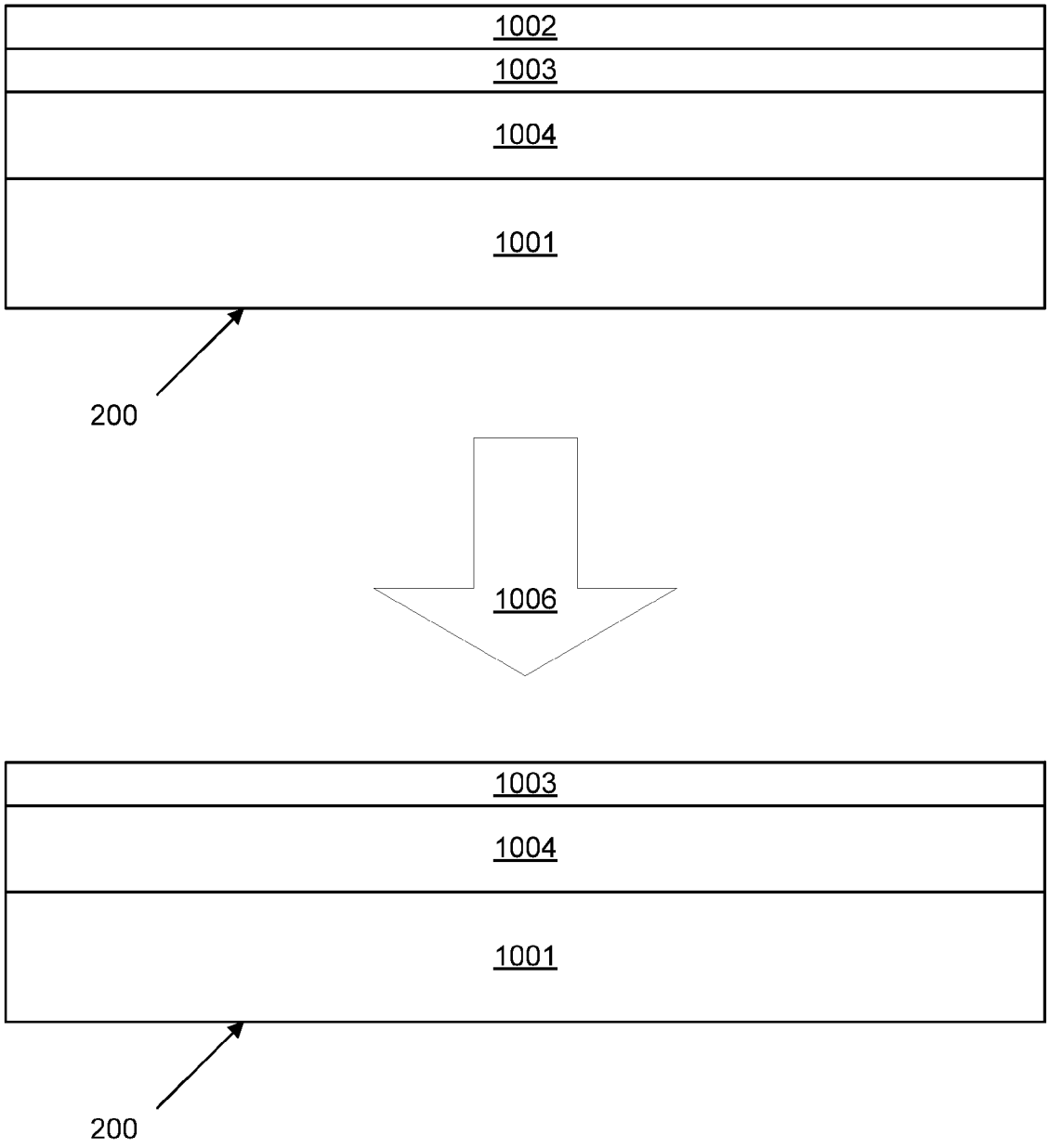
FIG. 10 is a schematic block diagram illustrating a cross-sectional view of a disk substrate.

FIG. 10 is a schematic block diagram illustrating a cross-sectional depiction of a method of planarizing a disk 200. The disk 200 includes a substrate layer 1001 and a magnetic layer 1004 applied onto the substrate layer. The magnetic layer 1004 can be formed using any of various techniques known in the art, such as patterned disk media or continuous perpendicular disk media techniques. For example, although shown schematically as a monolithic, non-patterned layer, the magnetic layer 1004 can include a plurality of discrete and spaced-apart magnetic domains or regions (i.e., magnetic bit patterns). Further, although not shown, the magnetic regions of the magnetic layer 1004 may be formed by etching gaps or recesses into the magnetic layer such that the gaps partition the magnetic layer into a plurality of magnetic domains. In certain implementations, a stop layer 1003 is applied onto the magnetic layer 1004. The stop layer 1003 may extend into the gaps formed in the magnetic layer 1004. Then, to fill in the gaps between the magnetic regions, a fill layer 1002 is applied onto the stop layer 1003. Accordingly, the fill layer 1002 is applied onto the stop layer 1003 whether within the gaps or on the magnetic regions. To ensure complete coverage of the fill layer 1002 in the gaps, the fill layer is applied above the magnetic domains and gaps. Although not shown, matching magnetic, stop, and fill layers 1004, 1003, 1002 may be applied on the to the opposing surface of the substrate 1001 such that the disk 200 forms a double-sided disk with matching layers on both sides of the disk. The planarization steps, apparatus, and associated benefits of the present disclosure as discussed above and below are equally applicable to double-sided disks as they are to single-sided disks.

To planarize the disk 200, a chemical-mechanical planarization process 1006 is employed, which removes the portion of the fill layer 1002 above the magnetic and stop layers 1004, 1003. For patterned disks, a portion of the fill layer 1002 remains within the gaps and above the stop layer. The remaining portions of the fill layer 1002 within the gaps effectively become part of the magnetic layer 1004. Accordingly, the chemical-mechanical planarization process 1006, as described above with reference to FIG. 8, effectively polishes and removes the fill layer 1002 until the stop layer 1003 that is on top of the land regions of the magnetic patterns is reached. For patterned media, the fill layer 1002 is polished until the portion of the stop layer 1003 deposited on the top land magnetic regions of the magnetic layer 1004 is reached, which as mentioned above, leaves some filler material in the gaps of the magnetic layer 1004 on top of the stop layer 1003.

When deposited, the stop layer 1004 may have a thickness in the range of between about 15 and 30 Å. But, because the polishing rate associated with prior art techniques is not completely uniform across the face of the unfinished disk 200, the fill layer in the gaps can be overpolished to create too much recession and, in some cases, at least some of the stop layer is removed unevenly during the polishing or removal of the fill layer 1002, which results in a non-uniform disk 200. For example, prior art processes often remove too much of the stop layer 1003 at the ID and/or OD of the disk due to a non-uniform polishing rate at the ID and/or OD. Any excess decrease in the thickness or removal of the fill layer between the stop layer 1003 due to overpolishing creates a recession in the fill layer. Some recessions with nominal depths in the fill layer are acceptable. However, prior art manufacturing processes often result in recessions of the fill layer that are not acceptable, e.g., recessions that are more than 30 Å. In addition, in some cases the overpolish is significant enough that the stop layer is partially or completely polished off and/or a portion of the underlying magnetic layer is polished off as well. Beneficially, the apparatus of FIGS. 3-7 prevents overpolishing in (e.g., the creation of unacceptable recessions in) the fill layer 1002, as well as prevents overpolishing and excessive thinning of the stop layer 1003. Put another way, the apparatus of FIGS. 3-7 more uniformly controls the characteristics of the recessions across the disk 200 and more uniformly controls the thinning of the stop layer.

As defined herein, the recessions in the gaps between the stop layer 1003 may be thought of as an average recession and referred to as the distance from the average position of the top surface of the stop layer (e.g., average the roughness laterally across a region of the surface) to the average position of the top of the groove (averaging over groove roughness). For example, in the embodiments described above with reference to FIGS. 3-7, the average recession may be in the range of about 3-20 Å (e.g., 10 Å), as compared to 30-60 Å or more with conventional processes. Accordingly, the apparatus of the present disclosure improves the recession uniformity across the disk, including at the ID and/or OD of the disk, compared to conventional processes.

To assist with recession uniformity, in certain implementations, the layers of the disk can be formed (via vacuum deposition, such as sputtering, or other techniques) such that the thickness of the stop layer 1003 is greater at the ID and/or OD portions of the disk (e.g., the areas of the disk proximate the ID and/or OD of the disk) as compared to the middle portion of the disk between the ID and OD portions (e.g., a middle diameter (MD) of the disk). The difference in thickness between the stop layer at the ID and/or OD portions and the middle portion can vary. In certain implementations, the thickness of the stop layer 1003 at the ID and/or OD portions of the disk can be between about 3 and 10 Å (e.g., about 5 Å) greater than the middle portion of the disk.

In some implementations, any recession in the stop layer between a radially outer periphery and radially inner periphery of the disk has a maximum depth of less than about 35 Å, less than 30 Å, or less than 15 Å. In one implementation, the recessions across the disk between the outer and inner peripheries vary by no more than 5% across the annular disk. In certain implementations, after planarization, the thickness of the stop layer is between about 5 Å and about 35 Å. In one implementation, the thickness of the stop layer varies by no more than 5% across the annular disk between the radially outer and inner peripheries.

In some embodiments, the stop layer 1003 is not needed and the layer below the fill layer 1002 (e.g., the magnetic layer 1004) serves the dual purpose of providing a patterned material with gaps that require filling by a filler material, as well as a stop layer. For example, for slurries capable of removing the fill layer 1002 at a high rate and removing the layer below the fill layer (e.g., magnetic layer 1004) at a much lower rate. Accordingly, removal of the fill layer 1002 can be performed until the magnetic layer 1004 is reached. However, in implementations without a stop layer 1003, even with specialized slurries, prior art planarization techniques would still be prone to applying too much pressure to the layer under the fill layer (particularly at the OD and ID of the disk) such that benefit of the lower removal rate of the slurries is effectively lost resulting in too much thinning of the layer below the fill layer 1002. Beneficially, the use of planarization techniques and apparatus of the present disclosure maintain a uniformly low pressure at the OD and ID of the disk such that the removal rate of the layer under the stop layer is acceptably small. Moreover, the discussion herein regarding the recession uniformity (including the recession depth modulation and thickness percentages) of the stop layer applies equally to the magnetic layer (or layer underneath the filler layer) in embodiments where the stop layer is omitted.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope

What is claimed is:

1. A method for chemical mechanical polishing of a disk, the method comprising:

providing a disk carrier comprising a surface configured to support an annular disk, the disk having an outside edge and an inside edge;

providing a raised ring extending from the surface of the disk carrier to a height greater than a height of the disk, the raised ring comprising an inside edge sized to be spaced apart from the outside edge of the annular disk when the annular disk is supported on the surface;

providing a raised column extending from the surface of the disk carrier to a height greater than a height of the disk, the raised column comprising an outside edge sized to be spaced apart from the inside edge of the annular disk when the annular disk is supported on the surface;

inserting a disk into the disk carrier; and polishing the disk using chemical-mechanical polishing.

2. The method of claim 1, further comprising providing a step disposed between the raised ring and the annular disk and having a height less than or equal to the height of the annular disk.

3. An apparatus comprising:

an annular disk;

a disk carrier comprising a surface configured to support the annular disk, the disk having an outside edge and an inside edge;

a raised ring extending from the surface of the disk carrier to a height greater than a height of the disk, the raised ring comprising an inside edge sized to be spaced apart from the outside edge of the annular disk when the disk is supported on the surface; and a raised column extending from the surface of the disk carrier to a height greater than a height of the disk, the raised column comprising an outside edge sized to be spaced apart from the inside edge of the annular disk when the annular disk is supported on the surface, wherein the raised column comprises a plug that is insertable into a central opening of the annular disk, the central opening defining the inside edge.

4. The apparatus of claim 3, further comprising a step disposed between the raised ring and the annular disk and having a height less than or equal to the height of the annular disk.

5. The apparatus of claim 3, wherein a difference in height of the raised ring and the annular disk is a ratio between about 1.01:1 and about 1.2:1.

6. The apparatus of claim 3, wherein a difference in height of the raised ring and the annular disk is a ratio between about 1.006:1 and about 1.8:1.

7. The apparatus of claim 3, wherein a difference in height between the raised column and the annular disk is a ratio between about 1.01:1 and about 1.2:1.

8. The apparatus of claim 3, wherein a difference in height between the raised column and the disk is a ratio between about 1.006:1 and about 1.8:1.

9. A system for simultaneously polishing a plurality of annular disks, the system comprising:

a plurality of annular disks each having an outer edge and inner edge;

a disk carrier having a plurality of annular-shaped recesses, each recess defining an outer wall and inner wall, and each of the plurality of recesses configured to receive a respective annular disk;

wherein the outer wall of each recess is adjacent the outside edge of the annular disk received in the recess, the outer wall having a height greater than a height of the disk, and wherein the outer wall is spaced apart from the outer edge of the annular disk received in the recess; and wherein the inner wall of each recess is adjacent the inside edge of the annular disk received in the recess, the inner wall having a height greater than a height of the disk, and wherein the inner wall is spaced apart from the outer edge of the annular disk received in the recess, and wherein the inner wall defines a protrusion that is insertable into a central opening of the annular disk, the central opening defining the inside edge.

10. The system of claim 9, further comprising a plurality of steps each disposed between the outer wall of a respective recess and the annular disk received in the respective recess, each step having an inner wall having approximately the same diameter as the outer edge of the annular disk received in the respective recess, and each step having a height less than or equal to the height of the annular disk received in the corresponding recess.

11. The system of claim 9, wherein the outer wall of the recess has at least one chamfered surface.

12. The system of claim 9, wherein the outer wall of the recess has a substantially rounded cross-sectional profile.

13. The system of claim 9, wherein the inner wall of the recess has at least one chamfered surface.

14. The system of claim 9, wherein the inner wall of the recess has a substantially rounded cross-sectional profile.

15. The system of claim 9, wherein a difference in height of one of the outer or inner walls of the recesses and the annular disks is a ratio between about 1.01:1 and about 1.2:1.

16. The system of claim 9, wherein a difference in height of one of the outer or inner walls of the recesses and the annular disks is a ratio between about 1.006:1 and about 1.8:1.

* * * * *